US006131223A

United States Patent [19]

Rehkemper et al.

[11] Patent Number: 6,131,223

[45] Date of Patent: Oct. 17, 2000

[54] DECORATING SCISSORS

[76] Inventors: Steven Rehkemper, 1030 N. State St., Apt. 29E; Jeffrey Rehkemper, 329 W. Evergreen, both of Chicago, Ill. 60610; Kerry E. Phillips, 1359 E. 158$^{th}$ St., South Holland, Ill. 60473

[21] Appl. No.: 09/365,393

[22] Filed: Aug. 2, 1999

[51] Int. Cl.$^{7}$ ..... B26B 11/00

[52] U.S. Cl. ..... 7/158; 7/135

[58] Field of Search ..... 7/158, 132, 133, 7/134, 135, 125, 169; 30/304, 230, 267

[56] References Cited

U.S. PATENT DOCUMENTS

| | | | |
|---|---|---|---|
| 3,883,953 | 5/1975 | Saullo et al. | 30/304 |
| 4,250,619 | 2/1981 | Buerkert et al. | 30/230 |
| 4,584,770 | 4/1986 | Sabol | 30/267 |
| 5,036,590 | 8/1991 | Reinke et al. | 30/304 |
| 5,054,699 | 10/1991 | DeJaynes | 241/101.2 |
| 5,072,515 | 12/1991 | Heitz | 30/304 |
| 5,400,452 | 3/1995 | Goldstein | 7/135 |
| 5,758,422 | 6/1998 | Frank | 30/230 |

*Primary Examiner*—Timothy V. Eley
*Assistant Examiner*—Dung Van Nguyen

[57] ABSTRACT

A novel scissors assembly having cooperating mating surfaces including a) cutting edges that fit into grooves to longitudinally slit a ribbon, b) a straight edge and cooperating groove to form the ribbon into a spiral loop, c) star wheels to corrugate a ribbon, and d) pinking shears to provide the ends with a zigzag cut.

11 Claims, 2 Drawing Sheets

FIG. 1
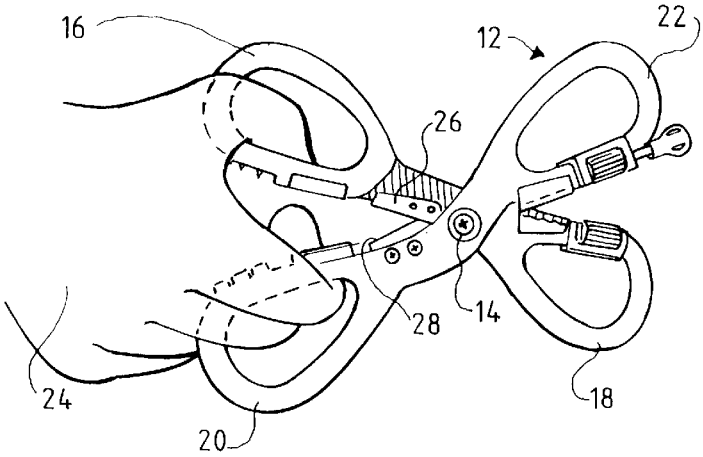
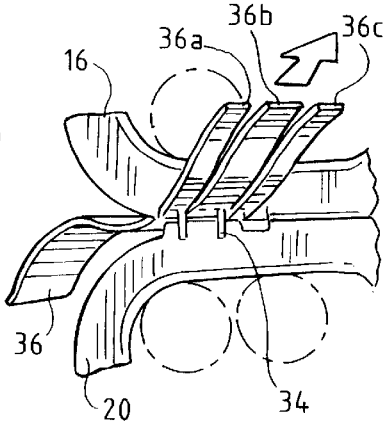
FIG. 2
FIG. 3
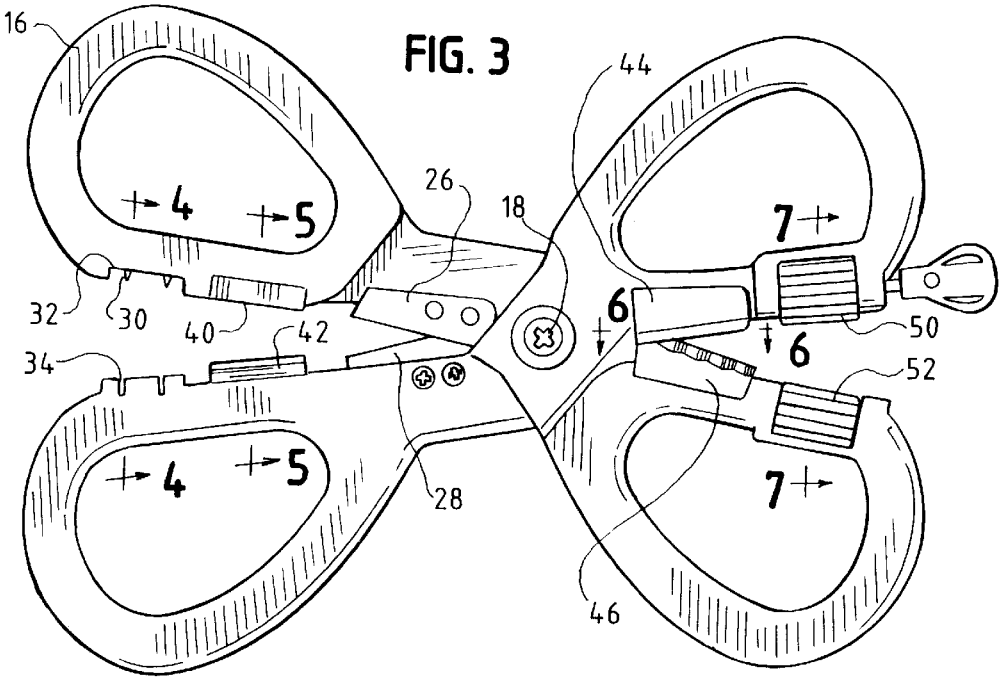
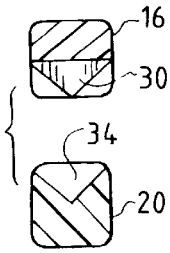
FIG. 4
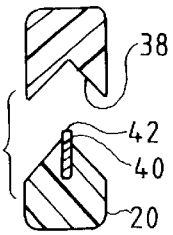
FIG. 5
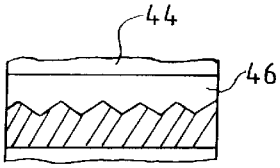
FIG. 6
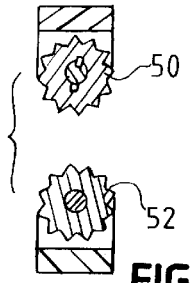
FIG. 7

DECORATING SCISSORS

FIELD OF THE INVENTION

This invention relates to a scissors assembly which can be used to form ribbon material into various sizes, shapes and configurations.

BACKGROUND OF THE INVENTION

Scissors have long been used to cut ribbons into different sizes, shapes or configurations. However, it has been necessary to use separate scissors to cut or form ribbons into the various desired shapes or arrangements. For example, you would use pinking shears with a saw toothed inner edge on the blades for making a zigzag cut. A different device would be needed if you wanted a corrugated effect or conventional scissors would be used for cutting a ribbon into narrower sections. Also, those who have wrapped ribbons around packages often use the edge of a scissors as a base upon which a ribbon is pressed to form the ribbon into a spiral loop.

It can be appreciated that it would be desirable to have available a single scissors assembly containing a plurality of different features whereby ribbons, or the like, can be cut into variously shaped or sized segments and also include the ability to form the ribbon into different attractive arrangements.

SUMMARY OF THE INVENTION

In accordance with the present invention, there is provided a unique scissors construction which includes a plurality of cooperating mating surfaces, which surfaces are designed so that ribbons can be cut into various segments or made into various configurations. Depending on the design of the mating surfaces the ribbon designs can take the form of serrated sections having saw-toothed edges, spiral loops, a corrugated design or slit sections, and other possible designs that are only limited by the configurations of the anvils and mating surfaces through which the ribbon is moved. In addition, the novel scissors can provide not only a plurality of different ribbon configurations and cuts, but is capable of performing the traditional scissors cutting function.

Specifically, when it is desired to slit a ribbon into plurality of longitudinally extending strips the mating surfaces consist of cutting edges that fit into grooves to perform the slitting action. To provide for spiraling a ribbon end the mating surfaces include a transversely extending V-shaped groove into which a straight edge moves so that the ribbon end will be spiraled but not cut as it is pulled therethrough. To provide for corrugation of the ribbon mating star wheels are provided and if desired one of the star wheels can be manually rotated to move the ribbon between the star wheels. A fourth ribbon treatment arrangement that can be incorporated in the novel scissors assembly includes a conventional pinking shears construction wherein the ribbon ends can be provided with a zigzag cut. One or more of these arrangements can be included along with a conventional scissors cutting blade arrangement.

BRIEF DESCRIPTION OF THE DRAWINGS

Referring to the drawings, there is shown a unique scissors assembly essentially consisting of a double handle arrangement in which cooperating portions of said scissors are designed to cut a ribbon into varying widths or configurations when the ribbon is moved therethrough.

FIG. 1 is a perspective view of a scissors assembly embodying the novel construction permitting the scissors to be used to form ribbons of various configurations and sizes;

FIG. 2 is a view illustrating one pair of mating surfaces in which the opposing surfaces are designed to cut the ribbon into three segments of whatever length desired as the ribbon is moved therethrough;

FIG. 3 is an enlarged view of the scissors shown being manipulated in FIG. 1;

FIG. 4 is a cross-sectional view taken along line 4—4 in FIG. 3 in which the ribbon is slit into three longitudinal sections;

FIG. 5 is a section taken along line 5—5 of FIG. 3 whereby the ribbon when pulled therethrough is formed into a spiral as shown in FIG. 8;

FIG. 6 is a section taken along line 6—6 of FIG. 3, in which mating surfaces acts as a pinking shears for forming a saw-toothed cut;

FIG. 7 is a sectional view taken along line 7—7 of FIG. 3 showing a pair of star wheels that give the ribbon a corrugated configuration as illustrated in FIG. 11 when moved therebetween;

BRIEF DESCRIPTION OF THE ILLUSTRATED EMBODIMENT

Figure 8:
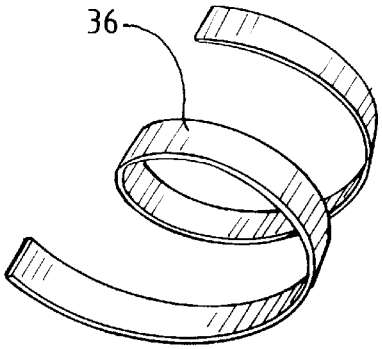
FIG. 8 illustrates a spirally formed ribbon.

Referring now to the novel scissors assembly, there is illustrated a unique scissors construction comprising two pivotally connected elongated members 10, 12 having handles at both ends thereof The members 10, 12 contain along their length various anvils and shapes in opposing relationship to provide for shaping or cutting of the ribbon disposed therebetween as it moved therethrough. Specifically, the two members 10, 12 of the scissors are pivotally connected by screw 14. The member 10 has handles 16, 18 at its ends and member 12 has handles 20, 22 at its ends. The handles 16, 20 and 18, 22 are disposed in opposed relationship and as shown in FIG. 1. The handles 16, 20 are shown gripped by hand 24 to provide the scissors action. The various pairs of mating surfaces on the members 10, 12 will be described in detail hereinafter. It is to be noted that located adjacent the pivot 14 are cooperating cutting blades 26, 28 on the members 10, 12, respectively, which is a conventional scissors construction that can be used to cut the ribbon from its source when desired.

Reference will now be made to the unique construction that enables the novel scissors assembly to form a variety of individual patterns be configuring the mating surfaces of the members in a particular way along their lengths. With the present invention a single scissors assembly can perform that which in the past has required a number of separate scissors.

Figure 10:
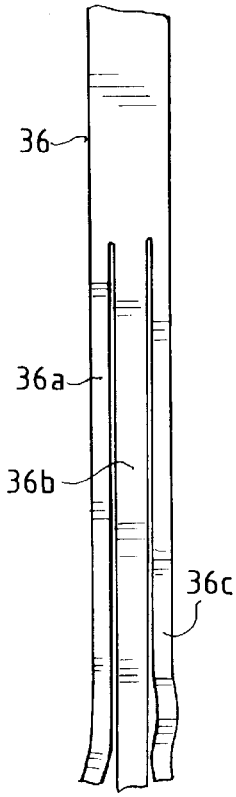
FIG. 10 shows a ribbon section slit into 3 segments.

Referring first to FIG. 4 this arrangement provides for cutting a single ribbon section into separate strips as shown in FIG. 10. The cross-sectional view of the mating surfaces consists of a series of cutting members 30 located in recess 32 in handle 16. The handle 20 defines a plurality of grooves 34 in which the cutting members 30 fit when the handles 16, 20 are pulled together. Thus, when a ribbon 36 is pulled therethrough in the manner as shown in FIG. 2 the ribbon is slit into three separate longitudinal segments 36*a*, 36*b* and 36*c* (FIG. 10).

When it is desired to form the end of the ribbon into a spiral loop the mating surfaces shown in FIG. 5 are employed. Heretofore this has been accomplished by holding the ribbon against the edge of a scissors which is awkward and can lead to an injury. As illustrated in FIG. 5 the mating surfaces consisting of a transversely extending groove 38 in handle 16 and a transversely extending blade 40 in handle 20 having a flat surface 42 that does not come together as shown with the result that the ribbon being pulled therethrough will not be severed, but will be formed into the spiral loop such as shown in FIG. 8.

Figure 9:
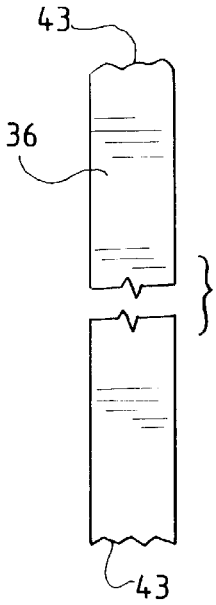
FIG. 9 illustrates a ribbon section having a saw-toothed cut.

On the right hand side of the pivot 14 there are provided mating surfaces that creates a saw toothed cut 43 at the end of a ribbon comparable to that obtained by a pinking shears. This includes an anvil 44 which mates with a serrated section 46 as shown in FIG. 6. The zigzag cut 43 is shown in FIG. 9.

Figure 11:
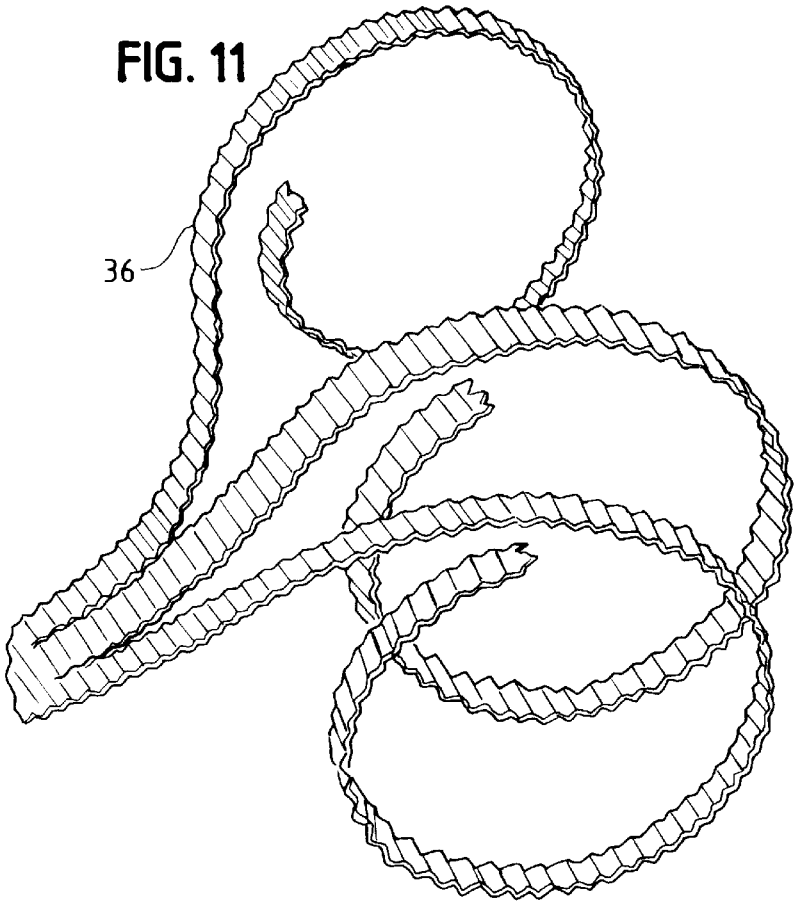
FIG. 11 illustrates a corrugated ribbon.

The double-handled scissors further includes a pair of mating star wheels 50, 52. The ribbon moved between the star wheels will take the form of a corrugated strip as shown in FIG. 11. As illustrated, the star wheel 50 is provided with a handle 54 which when rotated will positively move the ribbon between the star wheels 50, 52 to form the corrugations.

It can be seen that this novel double handled scissors assembly is a single unitary unit that can be used to form ribbons into a spiral shape, slit them into separate segments, corrugate them, or cut them with saw-toothed edges, as desired.

It is intended to cover by the appended claims all such modifications that fall within the true spirit and scope of the invention.

What is claimed is:

1. A double handled scissors assembly consisting of two longitudinally extending members having handle portions at their ends, means pivotally connecting said members intermediate their ends, said members having star wheels connected to opposing handle positions whereby when a ribbon is moved between the star wheels when in an engaging position the ribbon will be formed into a series of corrugations.

2. A scissors assembly as set forth in claim 1 in which one of the mating surfaces defines a transversely extending groove and the other mating surface is defined by a transversely extending straight edge adapted to fit into said groove whereby when a ribbon is pulled between said mating surfaces it forms into a spiral loop.

3. A scissors assembly as set forth in claim 2 including a star wheel rotatably secured to opposing handle portions whereby when a ribbon is moved between the star wheels when in an engaging position the ribbon will be formed into a series of corrugations.

4. A scissors assembly as set forth in claim 2 in which the opposing surfaces include an anvil and a saw-toothed edge portion whereby when the ribbon is disposed therebetween and opposing handles are moved toward engagement a saw-toothed edge will be formed on the ribbon.

5. A scissors assembly as set forth in claim 1 in which the opposing surfaces include an anvil and a saw-toothed edge portion whereby when the ribbon is disposed therebetween and opposing handles are moved toward engagement, a saw-toothed edge will be formed on the ribbon.

6. A scissors assembly as set forth in claim 1 in which there is a handle connected to one of said star wheels for rotating said star wheel.

7. A double-handled scissors assembly consisting of pivotally connected members having opposing handle portions at their ends, said members having a plurality of opposed mating surfaces, one of the mating surfaces defines a plurality of grooves and its opposed mating surface includes cutting edges whereby when the mating surfaces are brought into contact as a ribbon is pulled therebetween the ribbon will be split into a plurality of thinner longitudinal sections, said assembly also including a star wheel rotatively secured to each of said opposing handle portions whereby when a ribbon is moved between the star wheel when in an engaging position the ribbons will be formed into a series of corrugations.

8. A double handled scissors assembly as set forth in claim 7 in which the opposing surfaces also include an anvil and a saw-toothed edge portion whereby when the ribbon is disposed therebetween and said opposing handles are moved toward engagement a saw-toothed edge will be formed on the ribbon.

9. A double-handled scissors assembly consisting of pivotally connected members having opposing handle portions at their ends, said members having a plurality of opposed mating surfaces, one of the mating surfaces defines a transversely extending groove and edge adapted to fit into said groove whereby when a ribbon is pulled between said mating surfaces it is formed into a spiral loop, said assembly also including a star wheel rotatively secured to each of said opposing handle portions whereby when a ribbon is moved between the star wheel when in an engaging position the ribbons will be formed into a series of corrugations and the opposing surfaces also include an anvil and a saw-toothed edged portion, whereby when the ribbon is disposed therebetween and said opposing handles are moved toward engagement a saw-toothed edge will be formed on the ribbon.

10. A scissors assembly as set forth in claim 7, 8 or 9 is which one of the mating surfaces defines a transversely extending groove and the other mating surface is defined by a transversely extending straight edge adapted to fit into said groove whereby when a ribbon is pulled between said mating surfaces it forms into a spiral loop.

11. A scissors assembly as set forth in claim 7, 8 or 9 in which the opposed mating surfaces adjacent to a pivot define cutting blades.

* * * * *